US005569020A

United States Patent [19]

Griffin et al.

[11] Patent Number: 5,569,020

[45] Date of Patent: Oct. 29, 1996

[54] METHOD AND DEVICE FOR OPERATING A PREMIXING BURNER

[75] Inventors: Timothy Griffin, Ennetbaden, Switzerland; Peter Senior, Countesthorpe, Great Britain

[73] Assignee: ABB Research Ltd., Zurich, Switzerland

[21] Appl. No.: 550,351

[22] Filed: Oct. 30, 1995

[30] Foreign Application Priority Data

Nov. 5, 1994 [DE] Germany ..... 44 39 619.8

[51] Int. Cl.[6] ..... F23Q 9/00

[52] U.S. Cl. ..... 431/7; 431/284; 431/285; 60/39.822; 60/723

[58] Field of Search ..... 60/39.822, 723; 431/7, 284, 285

[56] References Cited

U.S. PATENT DOCUMENTS

| | | | |
|---|---|---|---|
| 2,970,439 | 2/1961 | Berl | 60/39.822 |
| 5,412,938 | 5/1995 | Keller | 60/723 |
| 5,489,203 | 2/1996 | Dobbeling | 431/284 |

FOREIGN PATENT DOCUMENTS

| | | |
|---|---|---|
| 0321809B1 | 6/1989 | European Pat. Off. . |
| 0576697A1 | 1/1994 | European Pat. Off. . |
| 1501965 | 1/1970 | Germany . |
| 3841269A1 | 6/1989 | Germany . |
| 4306956A1 | 9/1994 | Germany . |

OTHER PUBLICATIONS

"Catalytic Burner", Ozawa, No. 4–15410, Jan. 20, 1992, Patent Abstracts of Japan, M–1239, vol. 16, No. 169, Apr. 23, 1992.

*Primary Examiner*—Carroll B. Dority

*Attorney, Agent, or Firm*—Burns, Doane, Swecker & Mathis

[57] ABSTRACT

In a method of operating a low-pollution premixing burner (2) stabilized by means of vortex breakdown, in particular a burner of the double-cone type of construction, with gaseous fuels (4, 10), the main fuel gas (4) being fed to the burner (2) via a main gas tube (3) connected in one piece to the burner (2) and the pilot gas (10) being fed to the burner (2) near the axis of the latter via a separate feed line (9) by means of an exchangeably inserted fuel lance (8), and the pilot gas (10) being mixed inside the fuel lance (8) with air (17) fed from a plenum (16) outside the burner hood (6), the pilot-gas/air mixture (25) is fed to a catalyzer (21) arranged inside the fuel lance (8) at the tip of the burner (2) and is ignited and burnt there. The hot gas flow is then mixed with the colder main burner flow in the burner interior space (14).

8 Claims, 2 Drawing Sheets

FIG. 1
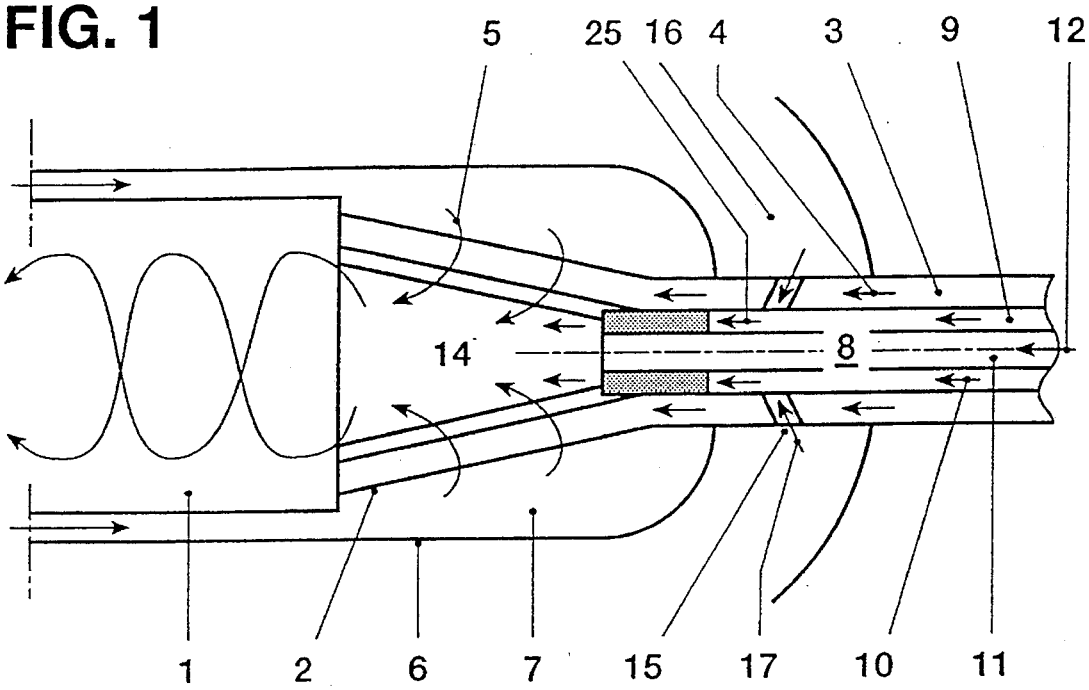
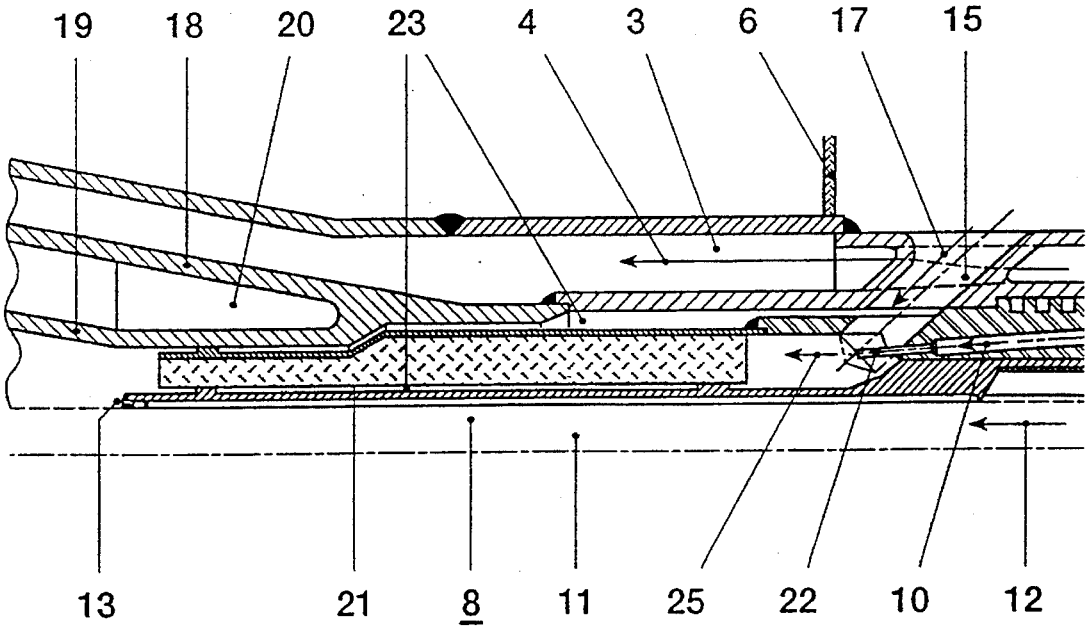
FIG. 2

METHOD AND DEVICE FOR OPERATING A PREMIXING BURNER

BACKGROUND OF THE INVENTION

1. Field of the Invention

The invention relates to a method and a device for operating a premixing burner, in particular a burner of the double-cone type of construction which is stabilized by means of vortex breakdown, is operated in particular with gaseous fuels and is preferably used in gas-turbine combustion chambers. The device in this case relates to the fuel feed.

2. Discussion of Background

In premixing burners, such as, for example, the double-cone burner according to EP 0 321 809, the aerodynamic phenomenon of vortex breakdown is utilized in order to recirculate the hot exhaust gases and thus stabilize the fuel/air mixture for low-pollution combustion. A vortex breakdown occurs when an axially symmetrical vortex spreading forward becomes unstable and creates a backflow zone in the axis.

The premixing burners are normally designed for typical gas-turbine operating modes in such a way that their fuel/air ratio produces the least NOx emissions during operation under full load. They are therefore operated near the lean extinction limit, and their regulating range is greatly restricted.

During partial load of the gas turbine or at lower fuel feed, it is therefore necessary in order to maintain the combustion to shut off individual burners so that the remaining burners can continue to be operated in a stable manner, or the combustion mass air flow must be reduced.

An increase in the zone of flame stability would reduce the need for or the requisite accuracy of such measures and at the same time considerably increase the output of the gas turbine.

One possibility of extending the stability range of the premixing burners is the additional injection of pilot gas effected near the axis, so that the fuel gases are enriched.

To operate a burner optionally with gaseous or liquid fuel, a method is known in which the fuel oil used as an alternative to the pilot gas is atomized by injection of air near the axis of the burner. The air injection is also effected during the pilot operation with gas, but no atomization is necessary during this operation. This additional air destabilizes the pilot-gas flame and thus reduces the lean extinction limit of the flame. A method and a device for operating a combined burner for liquid and gaseous fuels have therefore been developed in which burner the atomization of the liquid fuel is effected in an airblast nozzle and the gaseous fuel in the burner interior space is enriched near the axis of the burner by feeding in pilot gas, in the case of which method and device the inflow of the blast air into the burner interior space is controlled. Thus during operation with gaseous fuel the inflow of the blast air into the burner interior space is throttled, for example by the introduction of pilot gas into the blast air.

SUMMARY OF THE INVENTION

Accordingly, one object of the invention, in attempting to avoid all these disadvantages, is to enlarge the zone of flame stability with simple means in a premixing burner, stabilized by means of vortex breakdown and operated with gaseous fuels, for a gas-turbine combustion chamber, so that the premixing burner also works without problem under partial-load conditions or at very lean main-fuel/combustion-air mixtures.

According to the invention, this is achieved in a method according to the preamble of claim 1 when the pilot-gas/air mixture is fed to a catalyzer arranged inside the fuel lance at the tip of the burner and is ignited and burnt there, and the hot gas flow is then mixed with the colder main burner flow in the burner interior space.

According to the invention, this is achieved in a fuel feed for a low-pollution premixing burner stabilized by means of vortex breakdown, in particular a burner of the double-cone type of construction, according to the preamble of claim 4 when the feed means for the pilot gas and the pilot air is a jet pump arranged in the fuel lance, and when a catalyzer is arranged at the end of the fuel lance at the burner tip in an annular shape between the feed passage for the liquid fuel and the main gas passage.

The advantages of the invention can be seen inter alia in the fact that the zone of flame stability for a premixing burner stabilized by means of vortex breakdown is displaced in the direction of lean fuel/air mixtures and the efficiency of the plant is increased. The catalyzer starts the combustion without NOx generation and the resulting hot flow mixes with the colder main burner flow. A further homogeneous reaction is thereby delayed. The catalytic ignition is thus associated with hot-flow flame stabilization.

A further advantage of the invention consists in the fact that, on account of the arrangement of the catalyzer in the interchangeable fuel lance, the catalyzer can also be replaced very quickly if problems concerning operating safety occur. In addition, a fuel lance for a gas-turbine plant burner already in operation can be retrofitted with the catalyzer without problem.

It is especially convenient when the pilot gas is introduced under pressure by means of a jet pump integrated in the fuel lance and its pressure energy is utilized to introduce a sufficient quantity of combustion air from the plenum outside the burner hood into the fuel lance and to premix this quantity of combustion air with the pilot gas, since good mixing of pilot fuel and combustion air is thereby obtained and favorable high-pressure combustion of the gaseous fuel/air mixture is achieved.

Furthermore, it is advantageous when the combustion air is fed to the fuel lance in a swirled fashion, since the mixing between pilot fuel and combustion air thereby likewise takes place more effectively.

Finally, annular cooling spaces are advantageously arranged between the catalyzer and the feed passage for the liquid fuel and between the catalyzer and the main gas passage respectively. Overheating of the catalyzer and the fuel lance or the burner is thereby prevented.

Furthermore, it is convenient when an active catalyzer, preferably palladium oxide PdO, platinum, metal oxide mixtures or barium hexaaluminates, is used, in which case a honeycomb body having suitable cell density or pellets can be used as catalyzer carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a partial longitudinal section of the combustion chamber and the double-cone burner;

FIG. 2 shows an enlarged partial longitudinal section of the double-cone burner in the area of the cone apex and the fuel lance;

Figure 3:
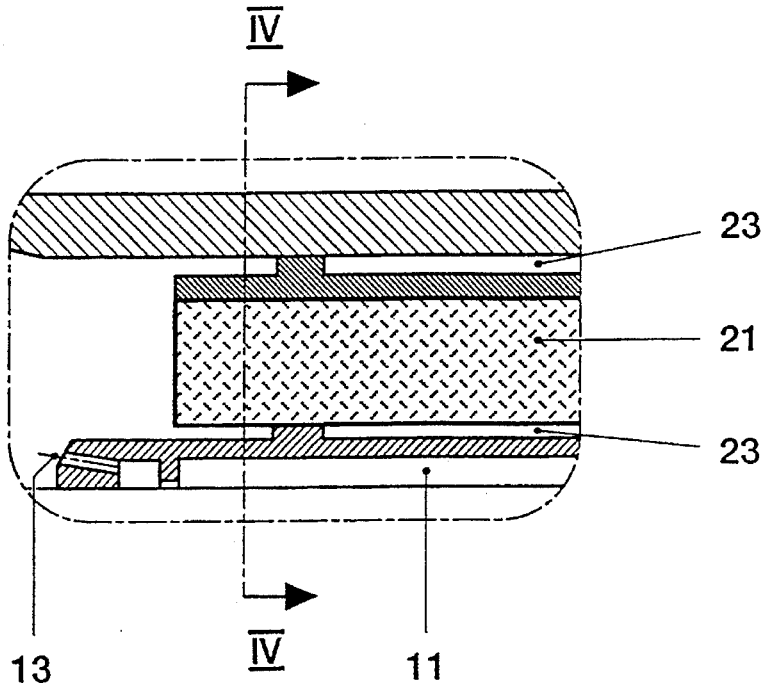
FIG. 3 shows an enlarged partial longitudinal section of the fuel lance in the nozzle area.

Only the elements essential for understanding the invention are shown. The direction of flow of the media is designated by arrows.

DESCRIPTION OF THE PREFERRED EMBODIMENTS

Referring now to the drawings, wherein like reference numerals designate identical or corresponding parts throughout the several views, FIG. 1 shows a partial longitudinal section of a gas-turbine combustion chamber 1 having a premixing burner 2. This premixing burner is a low-pollution double-cone burner which in its principle construction is described, for example, in EP-Bl-0 321 809. It essentially consists of two hollow sectional conical bodies making up one body and having tangential air-inlet slots, in which arrangement the center axes of the sectional conical bodies have conicity widening in the direction of flow and run offset from one another in the longitudinal direction. The two sectional conical bodies each have a fuel line 3 for feeding the gaseous main fuel 4, which is admixed to the combustion air 5 flowing through the tangential air-inlet slots.

Before it is mixed with the main fuel gas 4, the combustion air 5 serves as cooling air for the combustion chamber 1. The cooling air then collects in turn in a plenum 7 located inside the burner hood 6 before it is mixed with the main fuel. The mixture formation with the combustion air is effected directly at the end of the air-inlet slots.

The fuel lance 8 is easily exchangeable and contains feed means 9 for the gaseous pilot fuel 10, feed means 11 for a liquid fuel 12, which can be used if need be and is sprayed by a nozzle 13, for example a swirl nozzle or a mechanical atomizer, into the burner interior space 14, and feed means 15 for pilot air 17 fed from a plenum 16 outside the burner hood 6.

For the purpose of a more detailed representation, FIG. 2 shows an enlarged partial longitudinal section of the double-cone burner in the area of the cone apex and the fuel lance.

The main fuel 4 flows in the feed line 3 into the double-cone burner and mixes with the combustion air 5, which flows into the burner interior space of the double-cone burner 2 through the air-inlet slots 20 formed by the sectional conical bodies 18, 19. The fuel/air mixture is ignited only at the tip of the backflow zone, so that a stable flame front arises there. The flame does not flash back into the interior of the burner.

According to the invention, a catalyzer 21 is arranged inside the fuel lance 8 at the apex of the cone. It is located in an annular fashion between the feed passage 11 for the liquid fuel 12 and the feed passage 3 for the main fuel 4. Upstream of the catalyzer 21, a jet pump 22 is arranged in the fuel lance 8. By means of this jet pump 22 integrated in the fuel lance 8, the pilot gas 10 is introduced into the lance under pressure. At the same time, its pressure energy is utilized in order to introduce a sufficient quantity of pilot air 17 from the plenum 16 outside the burner hood 6 and to premix this pilot air 17 thoroughly with the pilot fuel. Further advantageous mixing can be achieved by fitting vortex elements in the feed passage 15 for the pilot air 17. The pilot-fuel/air mixture 25 then flows to the catalyzer 21 arranged at the tip of the double-cone burner. The catalyzer now initiates the combustion, in the course of which NOx emissions arise which are scarcely measurable. The hot gas flow produced by the catalyzer mixes with the colder main burner flow in the burner interior space 14 and thereby improves the stability of the main flame.

The zone of flame stability is substantially widened by the catalytic ignition being linked with hot-gas-flow flame stabilization.

Figure 4:
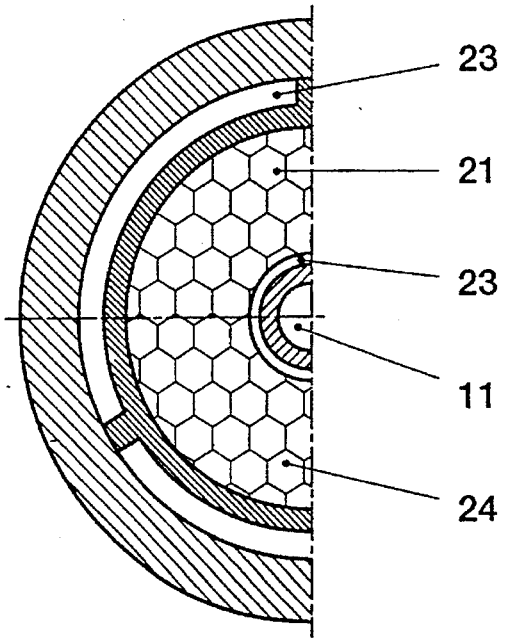
FIG. 4 shows a partial cross-section according to FIG. 3.

As clearly apparent from FIGS. 2 to 4, narrow annular cooling spaces 23 are arranged between the catalyzer 21 and the feed passage 11 for any liquid fuel 12 used as well as between the catalyzer 21 and the feed passage 3 for the main gas 4. These annular cooling spaces 23 serve to prevent overheating of the catalyzer 21 and the fuel lance 8.

Used as catalyzer 21 is a material which guarantees as high a catalytic activity as possible at sufficient thermal stability. The use of palladium oxide PdO is especially advantageous as catalyzer 21, since it is the most active material for the initiation of the methane oxidation.

Other thermally stable materials, somewhat less active catalytically compared with PdO, for example platinum, metal oxide mixtures (such as perovskites, spinels) or barium hexaaluminates, can of course also be used-in other exemplary embodiments.

FIG. 4 reveals a possible structure of the catalyzer carrier. The catalyzer 21 is arranged in a honeycomb body 24, in which arrangement the cell density of the honeycomb body 24 can be adapted to different stress conditions. The design has to be such that a sufficiently large catalyzer area is available.

The catalyzer 21 can be exchanged quickly and without problem. In addition, the fuel lances 8 of already existing burners 2 can be effectively retrofitted with this catalyzer 21 and the jet pump 22.

The previous exemplary embodiment related to a burner 2 which is operated with gaseous fuels 4, 10. But the invention can also be used for combined operation or for operation with liquid fuel 12. Although it is then unnecessary to introduce pilot gas 10 into the fuel lance 8, additional air 17 is instead pumped in with the jet pump 22, which additional air 17 can be additionally used for atomizing the liquid fuel 12, for example during partial-load operation. Although the catalyzer 21 has then lost its actual function, it also does not disturb the operating sequence.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A method of operating a low-pollution premixing burner (2) stabilized by means of vortex breakdown, in particular a burner of the double-cone type of construction, with gaseous fuels (4, 10), the main fuel gas (4) being fed to the burner (2) via a main gas tube (3) connected in one piece to the burner (2) and the pilot gas (10) being fed to the burner (2) near the axis of the latter via a separate feed line (9) by means of an exchangeably inserted fuel lance (8), and the pilot gas (10) being mixed inside the fuel lance (8) with air (17) fed from a plenum (16) outside the burner hood (6), wherein the pilot-gas/air mixture (25) is fed to a catalyzer (21) arranged inside the fuel lance (8) at the tip of the burner (2) and is ignited and burnt there, and the hot gas flow is then mixed with the colder main burner flow in the burner interior space (14).

2. The method as claimed in claim 1, wherein the pilot gas (10) is introduced under pressure by means of a jet pump (22) integrated in the fuel lance (8) and its pressure energy is utilized to introduce a sufficient quantity of combustion air (17) from the plenum (16) outside the burner hood (6) into the fuel lance (8) and to premix this quantity of combustion air (17) with the pilot gas (10).

3. The method as claimed in claim 2, wherein the combustion air (17) is fed to the fuel lance (8) in a swirled fashion.

4. A fuel feed for a low-pollution premixing burner (2) stabilized by means of vortex breakdown, in particular a double-cone burner, the main gas tube (3) for the gaseous fuel (4) being connected in one piece to the burner (2), and an easily exchangeable fuel lance (8) having feed means (9, 11, 15) for fuels (10, 12) and combustion air (17) being arranged in the main gas tube (3), wherein the feed means (9, 15) for the pilot gas (10) and the pilot air (17) are connected to a jet pump (21) arranged in the fuel lance (8), and wherein a catalyzer (21) is arranged at the end of the fuel lance (8) at the burner tip in an annular fashion between the feed passage (11) for the liquid fuel (12) and the main gas passage (3).

5. The fuel feed as claimed in claim 4, wherein annular cooling spaces (23) are arranged between the catalyzer (21) and the feed passage (11) for the liquid fuel (12) and between the catalyzer (21) and the main gas passage (3) respectively.

6. The fuel feed as claimed in claim 4, wherein active material, preferably palladium oxide, platinum, metal oxide mixtures or barium hexaaluminates, are used as catalyzer (21).

7. The fuel feed as claimed in claim 6, wherein a honeycomb body (24) having suitable cell density is used as catalyzer carrier.

8. The fuel feed as claimed in claim 6, wherein pellets are used as catalyzer carrier.

* * * * *